US005389020A

United States Patent [19]

Clark

[11] Patent Number: 5,389,020

[45] Date of Patent: Feb. 14, 1995

[54] MARINE PROP HOUSING

[76] Inventor: James D. Clark, 725 Thompson Rd., Algoa, Tex. 77511

[21] Appl. No.: 12,420

[22] Filed: Feb. 2, 1993

[51] Int. Cl.[6] ..... B63H 1/16

[52] U.S. Cl. ..... 440/67; 440/900

[58] Field of Search ..... 440/66, 67, 76–78, 440/83, 900; 60/221, 232; 415/209.1, 210.1, 213.1, 216.1; 239/265.19

[56] References Cited

U.S. PATENT DOCUMENTS

| | | | |
|---|---|---|---|
| 473,017 | 4/1892 | Peterson | 440/67 |
| 3,112,610 | 12/1963 | Jerger | 440/67 |
| 3,389,558 | 6/1968 | Hall | 440/67 |
| 3,849,982 | 11/1974 | Hall | 440/67 |

*Primary Examiner*—Robert J. Oberleitner
*Assistant Examiner*—Clifford T. Bartz

[57] ABSTRACT

A housing for the prop of a conventional gasoline or diesel powered marine engine is provided attachable to a bracket mount on the engine. The housing completely encloses the engine's prop and drive shaft and defines a tubular flow path for the water engaged by the prop with the flow path being generally coaxial with respect to the prop's rotation axis. The housing has an anterior inlet port of cross-sectional area A1 and a posterior outlet port of cross-sectional area A2 wherein A1>A2. A smooth transition of the different cross-sectional areas of the tubular housing is effected by an intermediate tapered section. Drive shaft extension means are provided so that the prop rotates in the region of the housing's least cross-sectional area.

3 Claims, 4 Drawing Sheets

MARINE PROP HOUSING

BACKGROUND OF THE INVENTION

1. Field of the Invention

The present invention relates generally to marine propeller assemblies, and more particularly to a housing for a motor-driven marine propeller.

2. Description of the Prior Art

It is known to surround the propeller of a power or motorboat with a guard to prevent the propeller from hitting objects in the water such as for example, various forms of animal and plant life habituating the marine environment in which the boat is navigating. Such guards typically comprise mesh-like structures with many openings so as minimize adversely affecting hydrodynamic interaction between the rotating prop and the surrounding water. A continuing need exists for a device which may be positioned about the rotating prop of a motorboat and which rather than diminishing the hydrodynamic efficiency of the motor/propeller drive assembly enhances efficiency, all of the while serving as a protective housing for the prop thus helping to avoiding collisions between the rotating prop and any submerged objects in the vicinity of the motorboat involved.

The foregoing need is met by the present invention as will be made apparent from the following description thereof. Other advantages of the present invention over the prior art also will be rendered evident.

SUMMARY OF THE INVENTION

To achieve the foregoing and other advantages, the present invention, briefly described, comprises a housing for the prop of a conventional gasoline or diesel powered marine engine attachable to a bracket mount on the engine. The housing completely encloses the engine's prop and drive shaft and defines a tubular flow path for the water engaged by the prop with the flow path being generally coaxial with respect to the prop's rotation axis. The housing has an anterior inlet port of cross-sectional area A1 and a posterior outlet port of cross-sectional area A2 wherein A1>A2. A smooth transition of the different cross-sectional areas of the tubular housing is effected by an intermediate tapered section. Drive shaft extension means arc provided so that the prop rotates in the region of the housing's least cross-sectional area.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved marine prop housing which has all of the advantages of the prior art and none of the disadvantages.

It is another object of the present invention to provide a new an improved marine prop housing which may be easily and efficiently manufactured and marketed.

It is a further objective of the present invention to provide a new and improved marine prop housing which is of durable and reliable construction.

An even further object of the present invention is to provide a new and improved marine prop housing which is susceptible of a low cost of manufacture with regard to both materials and labor, and which accordingly is then susceptible of low prices of sale to the consuming public, thereby making such marine prop housing available to the buying public.

Still yet a further object of the present invention is to provide a new and improved marine prop housing capable of increasing the efficiency of a standard marine engine and prop combination.

It is still a further object of the present invention is to provide a new and improved marine prop housing which serves the dual purpose of protecting the prop from seaweed, fish and other marine objects.

Still a further object of the present invention is to provide a new and improved marine prop housing including means for supporting a marine propeller therein.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved marine prop housing embodying the principles and concepts of the present invention will be described.

Figure 1:
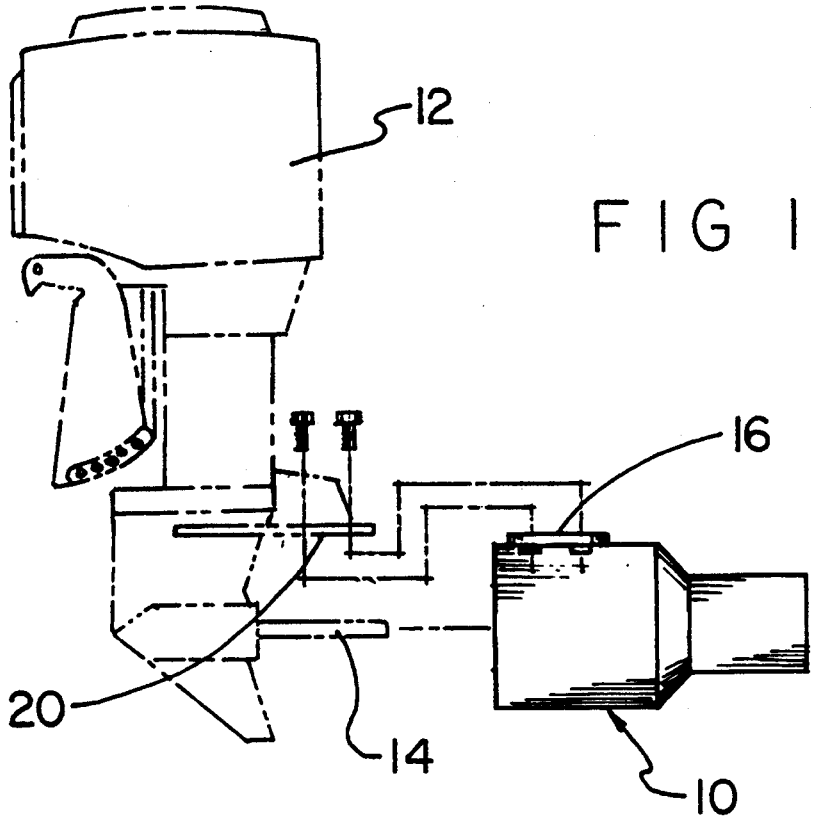
FIG. 1 is an elevational view showing a preferred embodiment of the marine prop housing of the invention in relation to a conventional outboard motor.

Turning initially to FIGS. 1–4, there is shown a first exemplary preferred embodiment of the marine prop housing of the invention generally designated by reference numeral 10 adapted to be suitably attached to the output drive shaft or spindle 14 of a conventional outboard marine engine 12 shown in phantom in FIG. 1 inasmuch as the details of the engine are well known and understood and form no part of the present invention. In its preferred form, marine prop housing 10 comprises a hollow tubular housing having an integral bracket 16 with holes 18 adapted to align with similar holes (not shown) in a mounting plate 20 integral with the engine 12 substantially as shown. The prop housing 10 is thus adapted to be affixed to the engine 12 via suitable fasteners 22 extending through the aligned holes in plate 20 and bracket 16 as will be apparent without further description.

More specifically, housing 10 comprises a first cylindrical end section 24, a second cylindrical end section 26 of reduced diameter with respect the first end section, and an intermediate tapered section 28 joining the first and second sections and forming a smooth transition therebetween. The openings defined by end sections 24 and 26 respectively comprise the inlet and outlet for housing 10 enabling water to flow through the housing upon rotation of a propeller assembly supported interiorly of the housing as will be explained further below.

In accordance with the invention, the diameter of first end section 24 may be represented by A1 and the diameter of second end section 26 may be represented by A2 with the relationship between diameters being equal to A1>A2. The ratio of A1 to A2 may vary within the range of about 1.25 to about 5 depending upon many factors including engine size, power output, hull size and weight, propeller blade pitch, and so on. Generally, an increase in the ratio will result in an increase in hydrodynamic efficiency leading to an increase in speed for a given engine output, or conversely to an increase in fuel economy for a given hull speed.

Figure 2:
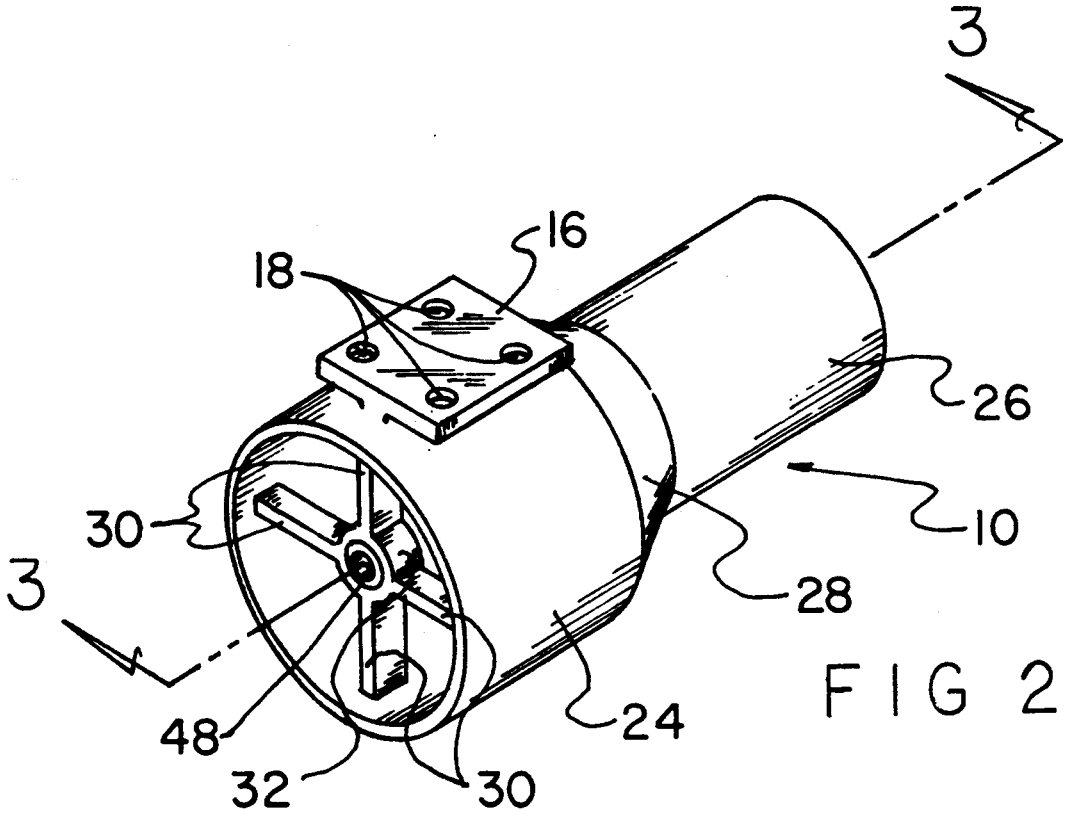
FIG. 2 is a perspective view of the marine prop housing of FIG. 1.
Figure 3:
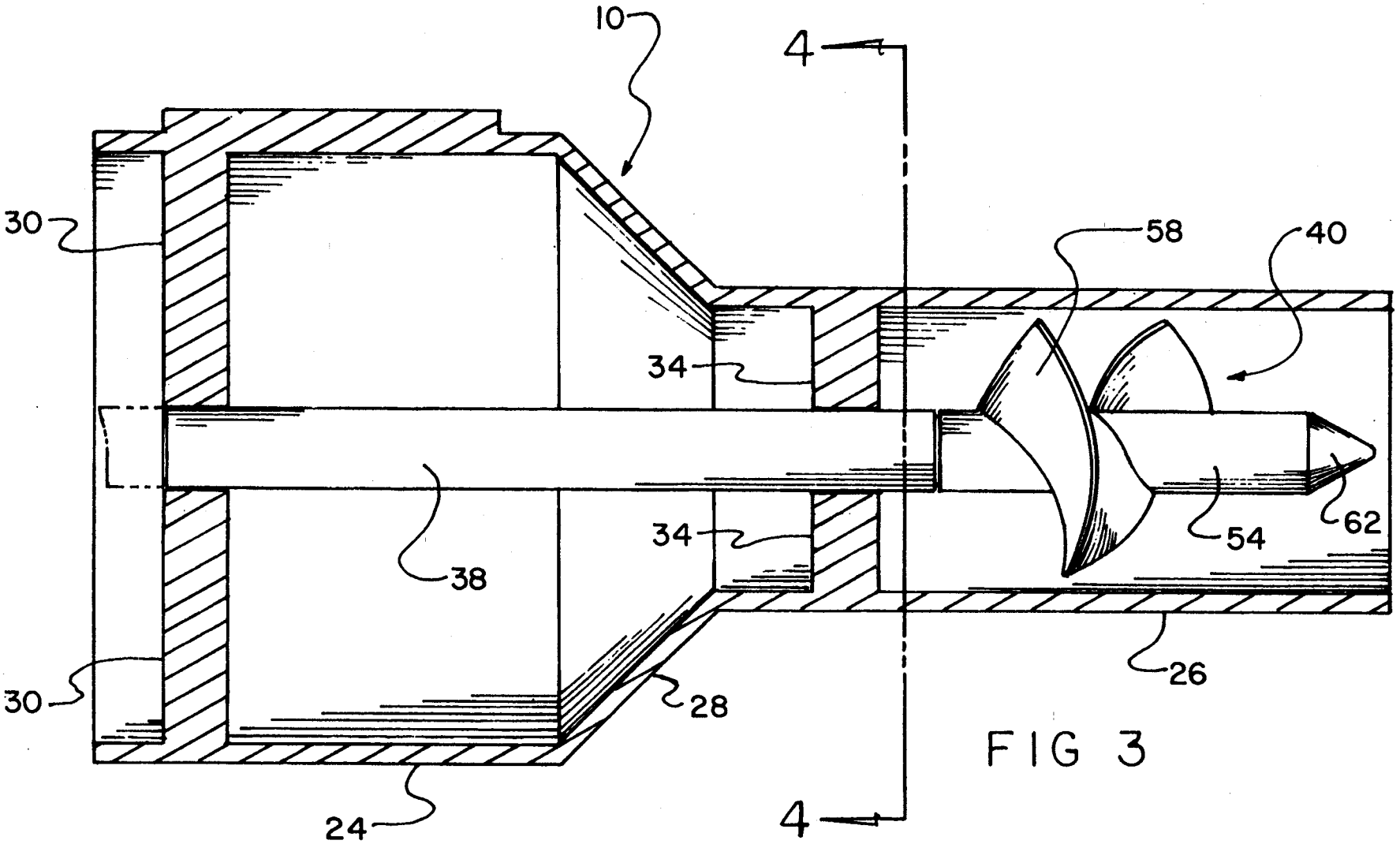
FIG. 3 is a cross-sectional view of the marine prop housing of FIG. 2 taken along line 3—3 thereof.
Figure 4:
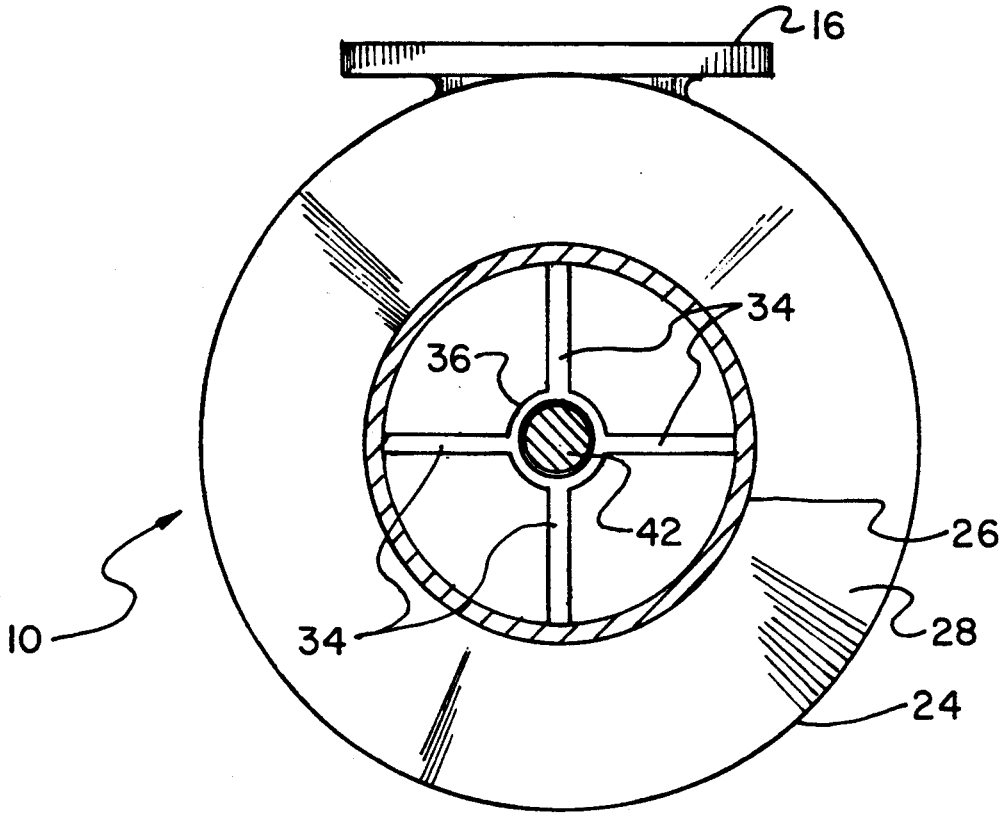
FIG. 4 is a cross-sectional view of the marine prop housing of FIG. 3 taken along line 4—4 thereof.

As best seen in FIGS. 2–4, there is disposed interiorly of housing 10 a first series of four evenly circumferentially spaced, fixed radial spokes 30 supporting a central bushing 32 coaxially with respect to section 24 of housing 10 and a second series of four evenly circumferentially spaced, fixed radial spokes 34 supporting a second central bushing 36 coaxially with respect to second section 26. Hence, bushings 32, 36 are coaxially aligned with respect to each other and to the longitudinal axis of the housing 10 and serve to support a fixed drive tube having a rotatably supported cylindrical drive shaft extending therethrough 38 which, in turn, serves as an extension or adaptor for the motor output shaft 14 and a marine propeller assembly generally designated by reference numeral 40 attached in a suitable manner to a portion of the cylindrical drive shaft extending from the distal end of tube 38 terminating in the reduced diameter section 26 as will be further described below. Hence, in accordance with the invention, and by the arrangement described and shown herein, propeller assembly 40 is supported for rotation in the reduced diameter or cross-sectional section 26 of housing 10.

Figure 5:
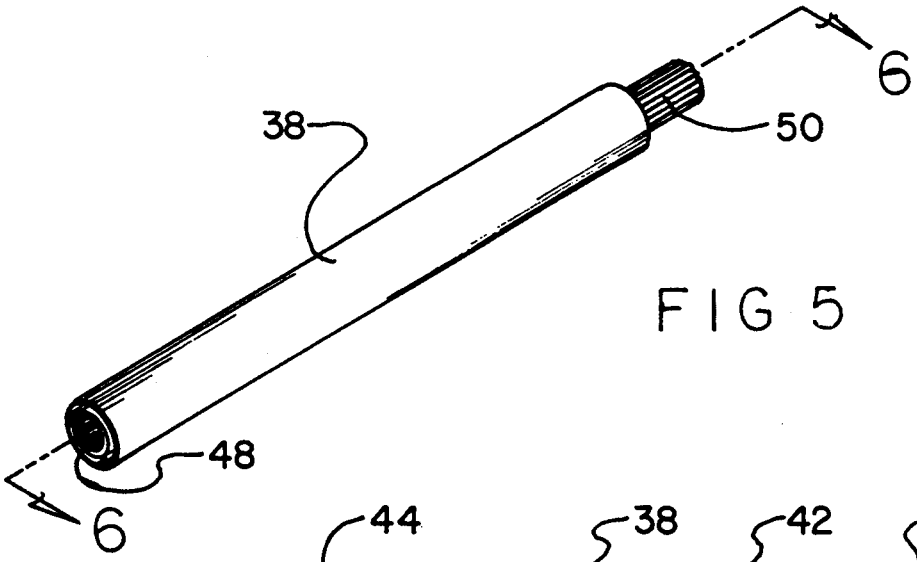
FIG. 5 is a perspective view of a drive shaft component of the embodiment of FIGS. 1–4.
Figure 6:
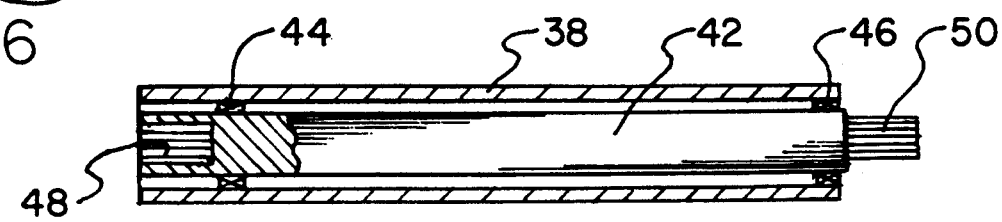
FIG. 6 is a cross-sectional view of the marine prop housing of FIG. 5 taken along line 6—6 thereof.
Figure 7:
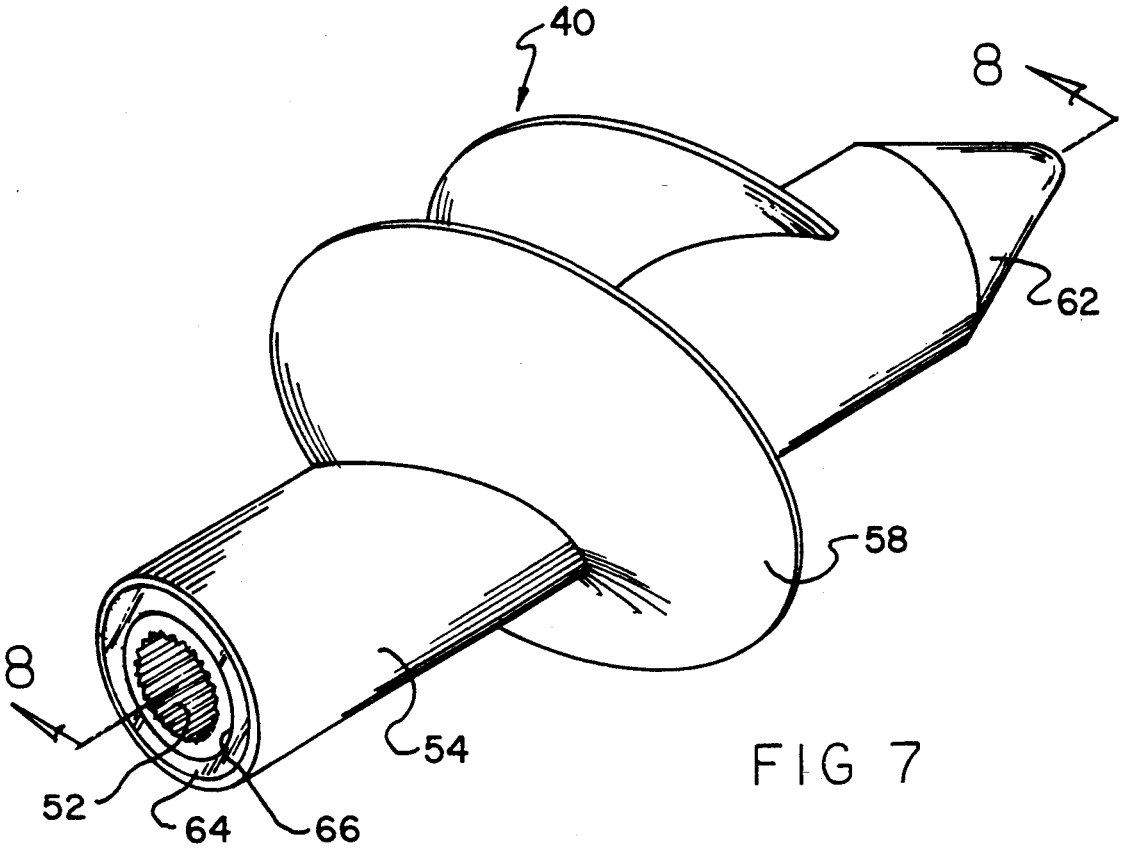
FIG. 7 is a perspective view of the preferred embodiment of the propeller used with the present invention.
Figure 8:
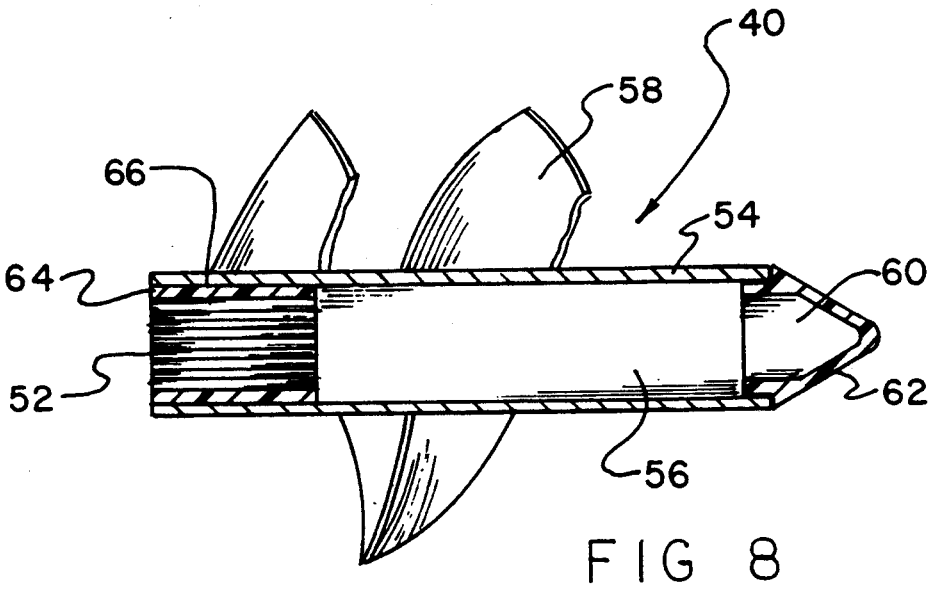
FIG. 8 is a cross-sectional view of the marine prop of FIG. 7 taken along line 8—8 thereof.

As shown in FIGS. 5 and 6, the preferred extension tube 38 is a cylindrical hollow tube and has a solid cylindrical drive shaft 42 coaxially supported for rotation therein about the tube's longitudinal axis by a pair of spaced thrust bearings 44, 46. The proximal end of shaft 42 has a splined receptacle 48 for receiving the splined end of motor output shaft 14 whereas the distal end of shaft 42 has a splined extension 50 for cooperating with the splined receptacle 52 on the leftmost end of propeller assembly 40 (FIGS. 7 and 8). Propeller assembly 40 preferably comprises a cylindrical jacket 54 press fit onto a solid cylindrical shaft 56 with the jacket having integrally formed thereon a helical propeller blade 58 suitable for marine use, i.e. efficiently propelling a boat hull through water. The distal end of shaft 56 terminates in a reduced diameter conically tapered tip which preferably is covered by a plastic conically shaped removable cover or "nose cone" 62 substantially as shown. The reduced section 60 defines a wrenching surface which advantageously may be used with a suitable tool (not shown) to press fit the propeller assembly onto extension 50 of shaft 42, i.e. force extension 50 into receptacle 52. Nose cone 62 may then be emplaced to provide a smooth hiring for the distal end portion of prop assembly 40. A plastic cylindrical sleeve 64 preferably is provided between the outer wall 66 defining receptacle 52 to serve as a shear pin enabling jacket 54 and propeller blade 58 to "shear off" shaft 56 in the event the propeller hits a solid object thereby preventing damage to engine 12.

In operation, rotation of propeller assembly 40 urges water to flow through the large diameter inlet defined by first end section 24 and be accelerated through the tapered intermediate section 28 and the reduced diameter end section 26 whereupon rotating propeller 58 is impacted by the stream of accelerated water which latter is caused to exit from the outlet opening defined by reduced section 26. The water flows smoothly through the housing 10 from left to right as shown in the drawings with minimal losses due to turbulence or friction because of the spaces between radial spokes 32 and 34 and the tapered intermediate section 28. As a result of the "nozzle effect" of the reduced size second end section 26 increased hydrodynamic efficiency thereby is achieved.

It is apparent from the foregoing that the present invention accomplishes all of the objectives set forth by providing a new and improved marine propeller housing capable of increasing the efficiency of a standard marine engine and prop combination, which serves the dual purpose of protecting the prop from seaweed, fish and other marine objects, and which includes means for supporting a marine propeller therein.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A marine propeller housing apparatus comprising:

a housing member symmetrically oriented about a longitudinal axis, said housing member including a first cylindrical end section having a first cylindrical end section diameter, an interior surface and first and second ends, an intermediate tapered section having a first end tapering to a second end, said intermediate tapered section first end being coupled to said second end of said first cylindrical end section, and a second cylindrical end section having a second cylindrical end section diameter, an interior surface and first and second ends, said second cylindrical end section first end being coupled to said second end of said intermediate tapered section, said first cylindrical end section diameter being substantially larger than said second cylindrical end section diameter;

mounting bracket means for securing said housing to a marine engine having a splined spindle;

a first series of radial spokes projecting inwardly from said interior surface of said first cylindrical end section proximal to said first cylindrical end section first end;

a second series of radial spokes projecting inwardly from said interior surface of said second cylindrical end section proximal to said second cylindrical end section first end;

a fixed drive tube centrally supported within said housing upon said radial spokes, said drive tube being substantially hollow and having a pair of spaced thrust bearings mounted within said drive tube;

a cylindrical drive shaft extending through said fixed drive tube and rotatably supported upon said bearings, said cylindrical drive shaft having a drive shaft splined receptacle at a first end thereof and a drive shaft splined extension at a second end thereof, wherein said drive shaft splined receptacle is engagable to a splined spindle of a marine engine;

and, a propeller assembly including a cylindrical jacket having a helical propeller blade secured to and extending around said cylindrical jacket, with a propeller assembly splined receptacle extending into and secured to said cylindrical jacket, said splined extension being received within said propeller assembly splined receptacle for mechanical rotational communication with a splined spindle of a marine engine with said propeller assembly being supported within said second cylindrical end section.

2. A marine propeller housing apparatus comprising:

a housing member symmetrically oriented about a longitudinal axis, said housing member including a first cylindrical end section having a first cylindrical end section diameter, an interior surface and first and second ends, an intermediate tapered section having a first end tapering to a second end, said intermediate tapered section first end being coupled to said second end of said first cylindrical end section, and a second cylindrical end section having a second cylindrical end section diameter, an interior surface and first and second ends, said second cylindrical end section first end being coupled to said second end of said intermediate tapered section, said first cylindrical end section diameter being substantially larger than said second cylindrical end section diameter;

mounting bracket means for securing said housing to a marine engine having a splined spindle;

a first series of radial spokes projecting inwardly from said interior surface of said first cylindrical end section proximal to said first cylindrical end section first end;

a second series of radial spokes projecting inwardly from said interior surface of said second cylindrical end section proximal to said second cylindrical end section first end;

a fixed drive tube centrally supported within said housing upon said radial spokes, said drive tube being substantially hollow and having a pair of spaced thrust bearings mounted within said drive tube;

a cylindrical drive shaft extending through said fixed drive tube and rotatably supported upon said bearings, said cylindrical drive shaft having a drive shaft splined receptacle at a first end thereof and a drive shaft splined extension at a second end thereof, wherein said drive shaft splined receptacle is engagable to a splined spindle of a marine engine;

and, a propeller assembly including a cylindrical jacket having a helical propeller blade secured to and extending around said cylindrical jacket, with a propeller assembly splined receptacle extending into and secured to said cylindrical jacket, said splined extension being received within said propeller assembly splined receptacle for mechanical rotational communication with a splined spindle of a marine engine with said propeller assembly being supported within said second cylindrical end section, said propeller assembly further comprising a plastic cylindrical sleeve interposed between an exterior surface of said propeller assembly splined receptacle and an interior surface of said cylindrical jacket, said plastic sleeve being operable to permit shearing thereof during impact of said propeller assembly with debris.

3. A marine propeller housing apparatus comprising:

a housing member symmetrically oriented about a longitudinal axis, said housing member including a first cylindrical end section having a first cylindrical end section diameter, an interior surface and first and second ends, an intermediate tapered section having a first end tapering to a second end, said intermediate tapered section first end being coupled to said second end of said first cylindrical end section, and a second cylindrical end section having a second cylindrical end section diameter, an interior surface and first and second ends, said second cylindrical end section first end being coupled to said second end of said intermediate tapered section, said first cylindrical end section diameter being substantially larger than said second cylindrical end section diameter;

mounting bracket means for securing said housing to a marine engine having a splined spindle;

a first series of radial spokes projecting inwardly from said interior surface of said first cylindrical end section proximal to said first cylindrical end section first end;

a second series of radial spokes projecting inwardly from said interior surface of said second cylindrical end section proximal to said second cylindrical end section first end;

a fixed drive tube centrally supported within said housing upon said radial spokes, said drive tube being substantially hollow and having a pair of spaced thrust bearings mounted within said drive tube;

a cylindrical drive shaft extending through said fixed drive tube and rotatably supported upon said bearings, said cylindrical drive shaft having a drive shaft splined receptacle at a first end thereof and a drive shaft splined extension at a second end thereof, wherein said drive shaft splined receptacle is engagable to a splined spindle of a marine engine; and, a propeller assembly including a cylindrical jacket having a helical propeller blade secured to and extending around said cylindrical jacket, with a propeller assembly splined receptacle extending into and secured to said cylindrical jacket, said splined extension being received within said propeller assembly splined receptacle for mechanical rotational communication with a splined spindle of a marine engine with said propeller assembly being supported within said second cylindrical end section, said propeller assembly further comprising a plastic cylindrical sleeve interposed between an exterior surface of said propeller assembly splined receptacle and an interior surface of said cylindrical jacket, said plastic sleeve being operable to permit shearing thereof during impact of said propeller assembly with debris, said propeller assembly still further comprising a plastic nose cone tip cover secured to a distal end of said cylindrical jacket opposite said propeller assembly splined receptacle.

* * * * *